United States Patent [19]

Vidal

[11] Patent Number: 4,564,967

[45] Date of Patent: Jan. 21, 1986

[54] BRIDGE ABUTMENT

[76] Inventor: Henri Vidal, Boulevard Maillot, Neuilly-sur-Seine, France

[21] Appl. No.: 558,915

[22] Filed: Dec. 6, 1983

[30] Foreign Application Priority Data

Dec. 6, 1982 [GB] United Kingdom ..... 8234688

[51] Int. Cl.[4] ..... E01D 19/02

[52] U.S. Cl. ..... 14/75; 14/26; 405/285

[58] Field of Search ..... 14/1, 15, 21, 26, 73–75, 14/77; 405/284, 285, 273; 52/79.11, 419, 429

[56] References Cited

U.S. PATENT DOCUMENTS

| | | | |
|---|---|---|---|
| 440,437 | 11/1890 | Phillips | 14/75 X |
| 534,032 | 2/1895 | Clymer | 14/75 X |
| 1,353,702 | 9/1920 | Aschauer | 52/372 X |
| 3,221,457 | 12/1965 | Vevoda | 52/429 X |
| 3,247,673 | 4/1966 | Schneller | 405/284 |
| 3,421,326 | 1/1969 | Vidal | 405/284 |
| 3,686,873 | 8/1972 | Vidal | 405/262 |
| 3,981,038 | 9/1976 | Vidal | 14/26 |
| 4,051,570 | 10/1977 | Hilfiker | 14/75 X |
| 4,380,409 | 4/1983 | O'Neill | 405/284 X |
| 4,426,176 | 1/1984 | Terada | 405/285 |
| 4,440,527 | 4/1984 | Vidal | 405/284 |

FOREIGN PATENT DOCUMENTS

| | | | |
|---|---|---|---|
| 70927 | 1/1916 | Austria | 405/285 |
| 3044182 | 6/1982 | Fed. Rep. of Germany | 405/284 |
| 1191104 | 5/1970 | United Kingdom | 405/284 |

*Primary Examiner*—Stephen J. Novosad
*Assistant Examiner*—Beverly E. Hjorth
*Attorney, Agent, or Firm*—Burns, Doane, Swecker & Mathis

[57] ABSTRACT

The invention provides a stabilized earth bridge abutment comprising a compacted earth mass containing reinforcing members therein to stabilize the mass, there being provided, in contact with said mass and close to a substantially vertical surface thereof, support means which bear the vertical load of the deck of the bridge while substantially all horizontal forces are absorbed by the stabilized earth mass.

In the method of constructing the stabilized earth bridge abutment an earth mass is built up from successive layers of earth and reinforcing elements and facing elements are attached to the ends of the reinforcing elements to provide a substantially vertical face, vertical spaces being provided close to said vertical face for subsequent introduction of support means to carry the deck of the bridge, and after the earth mass has been built and deformation of the earth mass due to its own weight has taken place, support means are introduced into said spaces.

19 Claims, 12 Drawing Figures

FIG.3.
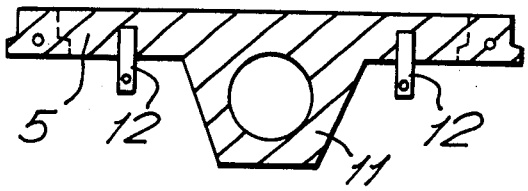
FIG.4.
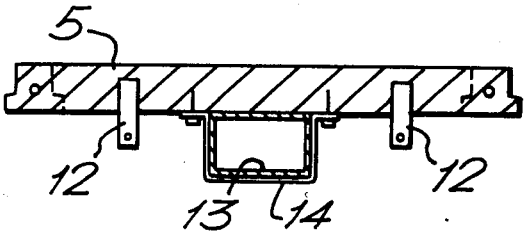
FIG.5.
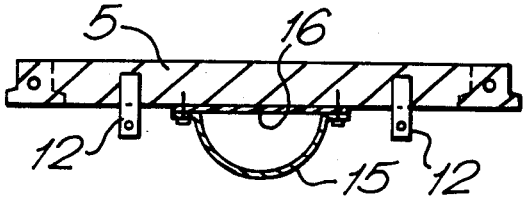
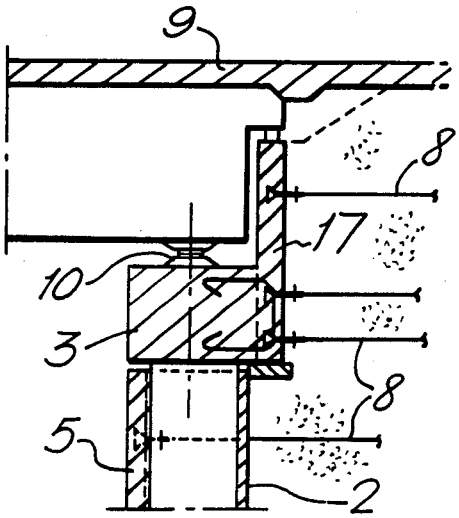
FIG.6.

BRIDGE ABUTMENT

The present invention relates to bridge abutments, more particularly to bridge abutments constructed from stabilised earth.

Conventional bridge abutments commonly comprise a massive reinforced concrete pier which carries all the bearing reactions of the bridge, both in the vertical and the horizontal direction. The approach to the deck of the bridge may be constructed from earth which may be stabilised in some way, but the earth mass is essentially independent of the concrete pier. Bridge abutments may also be constructed in which stabilised earth takes the vertical and horizontal load of the deck of the bridge but this requires a relatively massive beam seat resting on the stabilised earth and the total length of the deck of the bridge has to be extended by about one meter at each end. This increases the cost of the bridge and when a stabilised earth structure is offered as an alternative to a conventional reinforced concrete pier construction, it is necessary to redesign the whole bridge because of the increase in length. Such bridge abutments are described in my British Pat. No. 1,550,135.

I have now found it possible to construct stabilised earth bridge abutments wherein the vertical load of the deck of the bridge is supported substantially independently of the earth mass while the latter absorbs any horizontal forces.

Consequently, there is provided according to the invention a stabilised earth bridge abutment comprising a compacted earth mass containing reinforcing members therein to stabilise the mass, there being provided in contact with said mass and close to a substantially vertical surface thereof support means which bear the vertical load of the deck of the bridge while substantially all horizontal forces are absorbed by the stabilized earth mass.

In general, the support means will comprise a plurality of vertical pillars resting on a footing which pillars carry a beam seat. The pillars will normally be of reinforced concrete but may, in fact, be constructed from any durable, substantially incompressible material. The provision of independent load bearing means requires the earth foundation to be stable in order to avoid subsequent deformations of the stabilised earth mass; otherwise such deformation could transmit destructive forces to the support means. The footing will normally be a conventional reinforced concrete slab.

As indicated above, it is important that the beam seat be as close to the front face of the abutment as possible in order to keep the length of the deck of the bridge to a minimium. Consequently, the pillars or other vertical support means for bearing the vertical load will advantageously be situated as close as possible to the front face of the earth mass. The latter will normally be provided with an earth retaining facing which is relatively thin and flexible and is not intended to carry significant horizontal or vertical loads. This facing may thus be placed immediately in front of the vertical pillars of the support means and, indeed, may be substantially integral therewith:

It will be noted that the present form of construction protects the pillars or like support means from buckling, thus permitting these to be of relatively small cross-section and so comparatively flexible. Reinforcements embedded in the earth mass effectively retain the support means in position (via the facing) and this prevents buckling in the outward direction while the earth mass itself prevents buckling in the inward direction. Lateral buckling is prevented by the earth mass between the pillars and/or, where the pillars are integral with the facing also by the stiffness of the facing in its plane.

The deck of the bridge will normally rest on bearing blocks on the upper surface of the beam seat which in general are precisely aligned with the centre points of the supporting pillars below.

In order to assist the separation of vertical and horizontal forces, the beam seat may in some cases be mounted slidably on the tops of the pillars, e.g. on sliding or roller bearings. In general, however, the beam seat will be cast in situ so as to be integral with the tops of the pillars.

The approach to the deck of the bridge will, of course, be at the same level as the upper surface of the deck, that is substantially higher than the tops of the pillars. Consequently, it is desirable to provide an upper earth mass extending up to the required level and having a vertical face immediately behind the beam seat and the end of the deck seated thereon. An earth retaining panel will normally be provided on said vertical face. This may be a monolithic wall or may be attached to reinforcing members embedded in the earth mass. Such a panel may, in fact, conveniently be integral with the beam seat so that the latter is secured against outward movement and horizontal forces are absorbed by the reinforcing members. It is also possible for the earth mass behind the panel to be stabilised for example by cementation, rather than by reinforcing elements. In order to prevent vertical forces, arising from the passage of moving loads on the roadway above, from being transmitted through the above-mentioned panel to the beam seat, and hence shifting the resultant of the vertical load out of centre, the deck of the bridge advantageously overhangs the top of the panel. If this is not done, however, it is possible to compensate for such forces by placing the bearing blocks supporting the bridge deck forward of the centre line of the points of the pillars beneath the seat.

Alternatively, it is possible to allow some independent movement of the beam seat and the panel. In this case, the panel is placed a short distance behind the beam seat and is attached to reinforcing strips embedded in the upper earth mass.

In the construction of the bridge abutments according to the invention, it is important that all deformations of the stabilised earth mass arising during construction have taken place before the vertical elements of the support means, for example the concrete pillars, are positioned. Consequently, the abutment is built in two distinct phases. In the first phase, the earth mass is constructed in a conventional manner, (for example as in my United Kingdom Pat. Nos. 1,069,361, 1,324,686 and/or 1,550,135 except for provision of the footing for the support means). Thus, the reinforcements and facing elements, which are normally flexible or rigid plates or plates which articulate with one another, are put into position as the layers of the earth mass are laid one above the other with compaction of the earth fill at each stage. Progressive acummulative deformations of the earth mass take place at this stage as frictional forces are mobilised in the reinforcements to provide the desired stable structure. At this stage, vertical spaces in the earth mass have to be provided for subsequent introduction of the pillars or other support means.

Once the earth mass has been built up to its highest level, and all the deformations created by the weight of the earth mass have occurred, then assuming that the foundation soil is stable, any further deformation will be negligible. It is then possible, in the second phase of construction, to introduce the vertical pillars or other support means into the vertical spaces which have been provided for this purpose, without any need to allow for relative movement of the earth and the support means.

According to a further feature of the invention therefore, we provide a method of constructing a stabilised earth bridge abutment in which an earth mass is built up from successive layers of earth and reinforcing elements and facing elements are attached to the ends of the reinforcing elements to provide a substantially vertical face, vertical spaces being provided close to said vertical face for subsequent introduction of support means to carry the deck of the bridge and after the earth mass has been built and deformation of the earth mass due to its own weight has taken place, support means are introduced into said spaces.

In general, it is most convenient to introduce the pillars or other support means by pouring concrete into the above-mentioned vertical spaces (for example by means of a plunger tube), advantageously after introduction of suitable metal reinforcements.

The vertical spaces for introduction of the pillars or other support means are most conveniently provided by vertical hollow tubes of appropriate dimensions situated on the rearward side of the facing panels such that when the facing is assembled, these tube sections cooperate to provide a series of continuous pipes from the footing to the top of the facing.

Thus, according to a still further feature of the invention we provide a facing unit for a bridge abutment comprising a slab having edges adapted to cooperate with the edges of adjacent facing units and having on the rearward side a tube section so that in use the facing unit may cooperate with similar units in such a way that the tube sections thereof together constitute a vertical tube adapted to receive concrete.

Such tube sections may be constructed of concrete integral with the concrete of the facing panels or may be made from relatively thin tubes, for example of plastics sheeting, fibre-reinforced cement etc. secured to conventional facing panels. Such tubes may be tubular sections of material secured at intervals to the facing panels or channel sections of sheet material which are open to the rear surface of the facing panels so that on pouring in concrete, the resulting pillar will be integral with the facing. Another possibility is for the facing panels to be of box construction with pipes provided in the interior. It may be advantageous for the horizontal joints between the sections of pipe to be provided with interlocking or threaded end portions.

It may be advantageous for the vertical pipes to be lined with a compressible material such as felt in order to absorb slight differential movements between the stabilised earth and the pillars.

The horizontal joints between the tube sections formed in the above way may be provided with flexible cover plates, e.g. of thin sheet metal, plastics etc. to prevent loss of liquid from the poured concrete. Where such tubes are so thin and flexible that they are likely to be crushed during construction of the stabilised earth mass, they may advantageously be filled with aggregate during construction, thus preventing crushing while avoiding premature stiffening of the facing. In this case, the concrete pillars may be created by injecting grouting via a previously introduced tube. The pillars may sometimes comprise a mixture of aggregate and concrete or even, for small applications, compacted sand.

If the earth mass is built to the full roadway height before the pillars are introduced, it is necessary to create an upper facing panel, as mentioned previously, which retains the earth immediately behind the intended positions of the beam seat and bridge deck. If, for reasons relating to the construction of the bridge deck, it is not possible to provide such an upper facing panel, it may be desirable to subject the abutment to a temporary overload on a slope substantially up to the level of the roadway, this overload being partially removed when the superstructure is constructed. However, since the mass of earth between the tops of the pillars and the roadway is relatively thin, compared to the main mass of stablised earth, it may not be necessary to provide an overload of the above type, but simply to fill earth to the required level after the bridge structure is complete.

It is common practice to provide in a bridge abutment, a transition paving slab adjacent to the end of the deck of the bridge but supported by the earth section of the abutment. This allows for settlement of the earth due to instability of the foundation soil. Since abutments according to the present invention will not normally be built on unstable soil foundations, such a transition slab will never be strictly necessary since deformation of the abutment after construction is negligible. Nevertheless, in some cases a transition slab may be provided. It is possible for one end of the transition slab to rest on a shoulder or plate provided on the end of the deck of the bridge, so that all vertical forces pass down centrally through the bearing blocks. In this case, the transition slab conveniently protects the top of any earth retaining panel behind the beam seat from traffic loads. However, a gap may be left between the transition slab and the deck of the bridge, covered by an expanding roadway joint, in which case, the transition slab may be supported at one end by the earth retaining panel; this requires as stated above, that the bearing blocks supporting the deck of the bridge be forward of the centre line of the pillars.

A number of embodiments of the invention are now described by way of illustration only with reference to the accompanying drawings in which:

FIG. 1 shows a vertical cross-section of a bridge abutment according to the invention, FIGS. 2–5 show plan views of facing units provided with pipe sections for construction of pillars, FIG. 6 shows a vertical cross-section of the upper part of a bridge abutment according to the invention, FIG. 7 shows a vertical cross-section of the upper part of a bridge abutment having a transition slab, FIG. 8 shows a vertical cross-section of the upper part of a bridge abutment having a roadway joint but no transition slab, FIG. 9 shows a vertical cross-section of the upper part of a bridge abutment having a roadway joint and a transition slab but without a sliding bearing beneath the beam seat.

FIGS. 10–12 show vertical cross-sections of further bridge abutments according to the invention.

In the bridge abutment shown in FIG. 1, a foundation slab 1 carries a row of parallel pillars 2, there being a beam seat 3 resting on or integral with the upper surface of each pillar 2. The pillars 2 are secured by straps 6 to a facing comprising interlocking facing slabs 5 mounted edge-to-edge. An earth mass 7, stabilised by layers of steel strip reinforcements 8 in accordance with British Pat. Nos. 1,069,361 and 1,324,686, surrounds the pillars and extends rearwards to provide the main body of the abutment, the facing 5 being secured to the ends of the reinforcement strips for example by bolting the latter to steel tabs embedded in the facing. The beam seat 3 is similarly attached to reinforcing strips 8. The deck 9 of the bridge rests on bearing blocks 10 which lie directly above the centre lines of the pillars 2. The earth mass lying above the level of the beam seat 3 is not stabilised by reinforcements and is filled up to and in contact with the deck of the bridge.

FIG. 3 shows a facing unit similar to that of FIG. 2 wherein the hollow interior of the pipe section 11 is circular in cross-section.

FIG. 4 shows a reinforced concrete facing unit carrying pipe sections 13 made of thin metal sheet, secured to the facing slab by straps 14.

Figure 1:
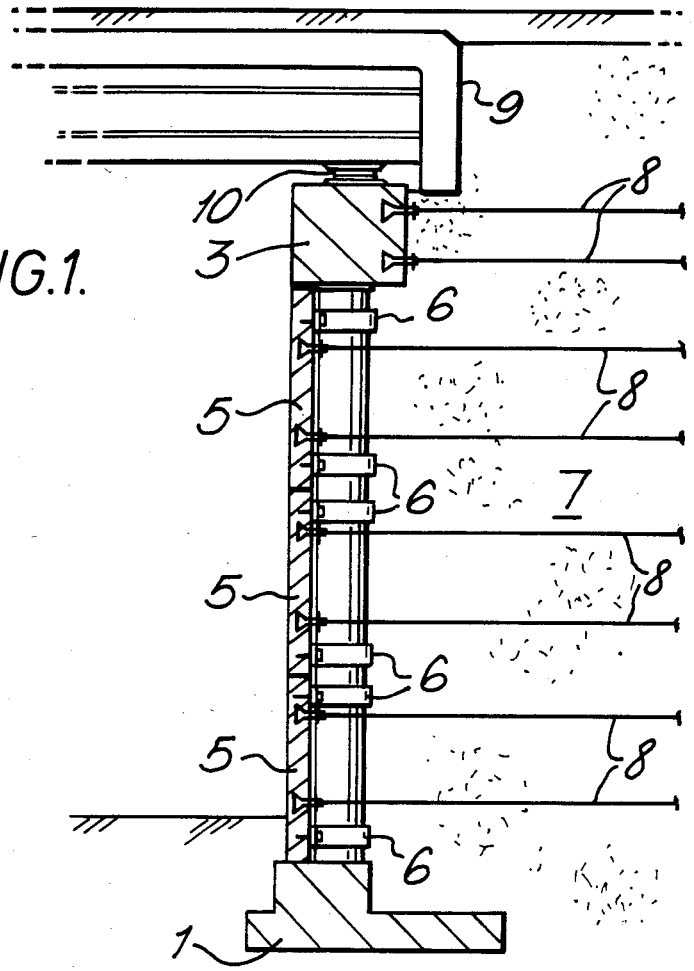
Figure 2:
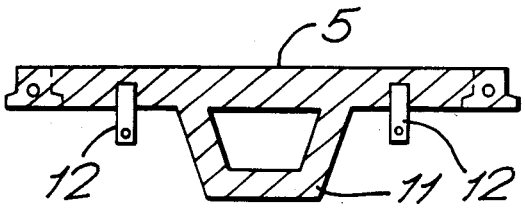
FIG. 2 shows a conventional reinforced concrete facing unit 5 provided on its rearward side with a hollow pipe section 11, also in reinforce concrete. Tabs 12 are provided for attachment to reinforcing strips.

FIG. 5 shows a reinforced concrete facing unit 5 carrying a thin sheet metal channel 15 secured to the rear side thereof via a gasket 16. In operation, the facing units 5 shown in FIGS. 2–5 may be assembled in vertical edge-to-edge relationship so that the rearward pipe sections 11, 13 or 15 respectively, cooperate to form a vertical pipe, the horizontal joints between the sections of pipe being provided with substantially water tight joint covers. It may be advantageous to line the pipe sections with a compressible material such as felt.

In the construction shown in FIG. 6, the beam seat 3 is mounted on the pillars 2 secured to the facing units 5 attached to reinforcing strips 8. A reinforced concrete retaining panel 17 is integral with the beam seat 3. Traditionally, such panels are cast at the same time as the beam seat. In practice, however, conventional facing units of the same type as facing units 5 (but without rearward tube sections) may be provided with reinforcing rods extending outwards from their faces and the beam seat may then be cast in contact with the assembled facing to produce an integral structure. It may be desirable to cast the beam seat also in contact with the tops of the pillars so as to be integral therewith. Further reinforcing strips 8 may be attached to the rear of the panel 17 to stabilise the earth mass at that level. Such strips may be attached to both the upper and lower parts of the panel 17 (as shown) or may be attached only in the lower part in the region of the beam seat. The deck 9 of the bridge overhangs the top of the panel 17 so protecting it from vertical loads. The loads transmitted to the pillars 2 via bearing blocks 10 are centred as far as possible, subject to the effects of distortion of the supporting earth mass and of the small differences in levels between the pillars and the reinforcing strips which balance out the horizontal stresses.

Figure 7:
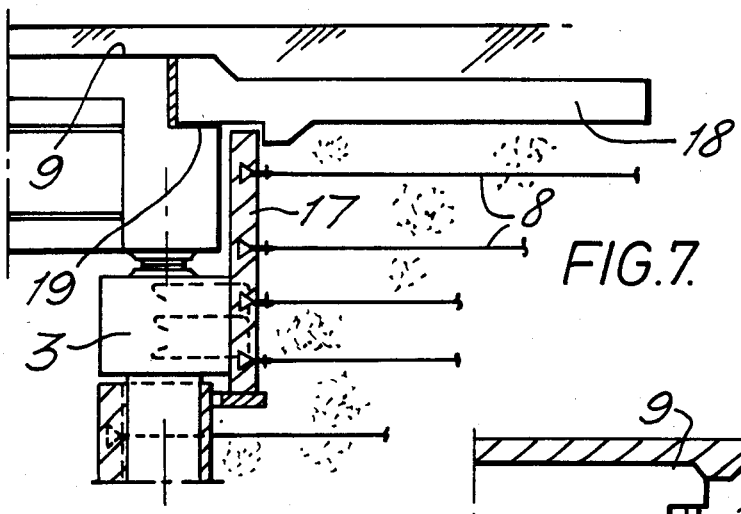

In the structure shown in FIG. 7, a transition slab 18 is mounted on a shoulder 19 of the deck 9, thereby protecting the panel 17 from vertical loads and compensating for any differential movement of the earth and the deck of the bridge.

Figure 8:
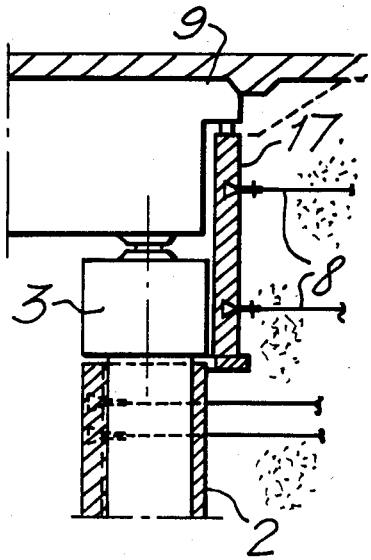

In the structure shown in FIG. 8, the panel 17 is independent of the beam seat 3 and is separately supported by reinforcing strips. The beam 9 overhangs the panel 17 to protect it from vertical loads.

Figure 9:
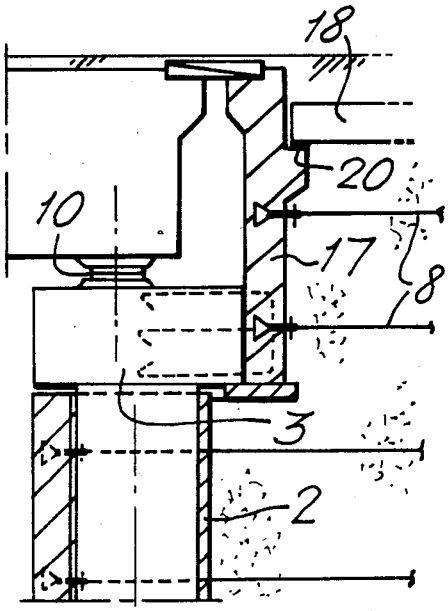

The structure shown in FIG. 9 has a transition slab 18 resting on a shoulder 20 of the earth retaining panel 17. Thus, vertical forces are transmitted to the panel 17 and since this is integral with the beam seat 3, such forces tend to throw the loading on the pillars 2 out of centre. In this design, the beam seat 3 is integral with the tops of the pillars 2, so that the latter are under composite bending stress and have to absorb the horizontal forces from the beam. In partial compensation, however, the bearing blocks 10 are moved forward from the centre line of the pillars. The reinforcing members attached to the beam seat then have virtually no function other than supporting the thrust of the earth.

Figure 10:
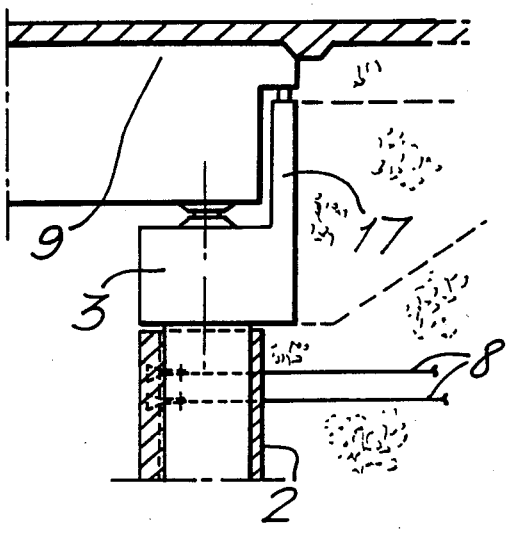

The structure shown in FIG. 10 has a retaining panel 17 integral with the beam seat 3 as in FIG. 6. However, the earth behind the retaining panel 17 is stabilised by means other than reinforcement strips, for example by cementation.

Figure 11:
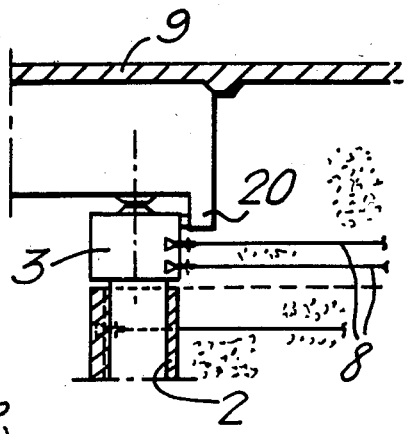

The structure shown in FIG. 11 has no retaining panel behind the beam seat 3, but the beam 9 is provided with an extension 20 which lies behind the upper part of the beam seat 3, which is attached to reinforcing elements 8. However, it is possible to continue the extension 20 lower, in which case there are no reinforcing elements and the earth behind the extension 20 then is preferably stabilised by, for example, cementation.

Figure 12:
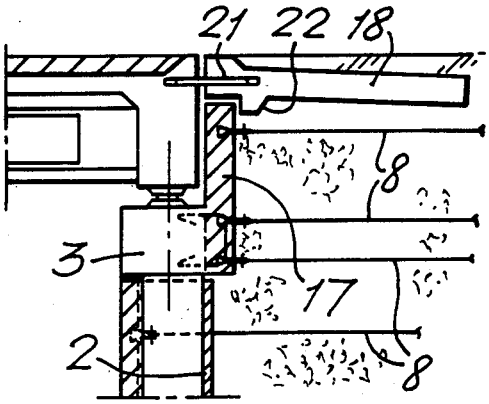

The structure shown in FIG. 12 has a retaining panel 17 integral with the beam seat 3 as in FIG. 6. However, the beam 3 itself does not overhang the panel 17 but a transition slab 18 is supported in relation to the beam 3 by a plate 21. The slab 18 has a shoulder 22 which serves to locate the top of the panel 17. The panel 17 is preferably attached to reinforcements 8 embedded in earth behind the panel and, in part, beneath the slab 18. The earth may, however, be stabilised by other means, for example cementation, in which case there are no reinforcing strips attached to the panel 17.

I claim:

1. A stabilized earth bridge abutment comprising a compacted earth mass containing reinforcing members therein to frictionally stabilise the mass, there being provided, in said mass and close to a substantially vertical surface thereof, support means which bears the vertical load of the deck of the bridge while substantially all horizontal forces are absorbed by the stabilised earth mass.

2. An abutment as claimed in claim 1 in which said support means comprises a plurality of vertical pillars resting on a footing and extending vertically above the vertical surface of the mass.

3. An abutment as claimed in claim 2 in which the earth mass carries an earth retaining facing on at least the said vertical surface.

4. An abutment as claimed in claim 1 in which the earth mass carries an earth retaining facing on at least the said vertical surface.

5. An abutment as claimed in claim 4 in which the facing is integral with said support means.

6. An abutment as claimed in claim 5 in which the facing comprises interlocking facing elements at least some of which are integral with vertical pillars constituting said support means.

7. A facing unit for a bridge abutment comprising a slab having edges adapted to cooperate with the edges of adjacent facing units and having on the rearward side a tube section sized to provide columnar vertical support for a bridge deck so that in use the facing unit may cooperate with similar units in such a way that the tube sections thereof together constitute a vertical tube adapted to receive concrete which forms a columnar support.

8. A unit as claimed in claim 7 constructed of reinforced concrete.

9. A method of constructing a stabilised earth bridge abutment in which an earth mass for resisting horizontal forces is built up from successive layers of earth and reinforcing elements and facing elements are attached to the ends of the reinforcing elements to provide a substantially vertical face, providing vertical spaces close to said vertical face for subsequent introduction of support means to carry the deck of the bridge, and after the earth mass has been built and deformation of the earth mass due to its own weight has taken place, introducing support means into said spaces for substantially all vertical loads imposed on the abutment, said support means extending from beneath the vertical face to above the vertical face.

10. A method as claimed in claim 9 in which said vertical spaces are substantially tubular and the support means are pillars formed by introducing concrete into the spaces.

11. A method as claimed in claim 10 in which the vertical spaces are provided by vertical pipes integral with facing elements attached to said reinforcing elements during construction of the earth mass.

12. A method as claimed in claim 11 in which, after introduction of said support means, a beam seat is provided thereon to carry the deck of the bridge.

13. A stabilized earth bridge abutment comprising:

compacted earth mass means containing reinforcing members therein to stabilize the mass means and including a substantially vertical face, the mass means being operable to resist horizontal forces acting on the abutment, the substantially vertical face being substantially free of vertical loading; and support means extending vertically through the compacted earth mass means from a point above the vertical face, for supporting substantially all the vertical load of a bridge deck supported on the abutment.

14. An abutment as claimed in claim 13 in which said support means comprises a plurality of vertical pillars resting on a footing.

15. An abutment as claimed in claim 13 in which the earth mass means carries an earth retaining facing on at least the said substantially vertical face.

16. An abutment as claimed in claim 15 in which the facing is integral with said support means.

17. An abutment as claimed in claim 15 in which the facing comprises interlocking facing elements at least some of which are integral with vertical pillars constituting said support means.

18. The bridge abutment according to claim 17 wherein vertically aligned facing elements have a tube section on the rearward side thereof so that in use the facing elements may cooperate with similar elements in such a way that the tube sections thereof together constitute a vertical tube adapted to receive concrete.

19. The bridge abutment according to claim 18 wherein the facing elements are constructed of reinforced concrete.

* * * * *